US008381921B2

(12) United States Patent
Tan

(10) Patent No.: US 8,381,921 B2
(45) Date of Patent: Feb. 26, 2013

(54) ROLLING EXTENSION TRAY BAG DISPENSER RACK

(76) Inventor: Daniel Brian Tan, Harahan, LA (US)

( * ) Notice: Subject to any disclaimer, the term of this patent is extended or adjusted under 35 U.S.C. 154(b) by 230 days.

(21) Appl. No.: 12/939,671

(22) Filed: Nov. 4, 2010

(65) Prior Publication Data

US 2012/0111810 A1 May 10, 2012

(51) Int. Cl.
*A47F 5/025* (2006.01)
*A47F 13/085* (2006.01)

(52) U.S. Cl. ..... 211/85.15; 211/12; 211/126.1

(58) Field of Classification Search ..... 211/85.15, 211/12, 181.1, 126.15, 85.29, 116, 126.1, 211/133.5, 133.6; 312/247, 334.23, 334.26; 108/26; 248/298.1
See application file for complete search history.

(56) References Cited

U.S. PATENT DOCUMENTS

| | | | | |
|---|---|---|---|---|
| 2,839,349 | A * | 6/1958 | Culver | 312/323 |
| 3,896,966 | A | 7/1975 | Canno | |
| 4,407,473 | A | 10/1983 | Howe, Jr. | |
| 4,441,771 | A * | 4/1984 | Roesler | 312/322 |
| 5,209,371 | A | 5/1993 | Daniels | |
| 5,244,272 | A * | 9/1993 | Thompson | 312/334.23 |
| 5,269,423 | A | 12/1993 | Nguyen | |
| 5,350,229 | A * | 9/1994 | Smed | 312/334.23 |
| 5,405,021 | A | 4/1995 | Smithson | |
| 5,524,763 | A | 6/1996 | Wile | |
| 5,584,402 | A | 12/1996 | Johnson | |
| 5,584,404 | A * | 12/1996 | Tsai | 211/94.01 |
| 5,707,034 | A * | 1/1998 | Cotterill | 248/284.1 |
| 5,871,115 | A | 2/1999 | Kohn | |
| 5,957,558 | A * | 9/1999 | Quade | 312/323 |
| 6,039,422 | A | 3/2000 | Butters et al. | |
| 6,098,806 | A | 8/2000 | Mills | |
| 6,543,638 | B2 | 4/2003 | Wile | |
| 6,655,546 | B1 | 12/2003 | Bolton et al. | |
| 6,733,095 | B1 * | 5/2004 | Rieb | 312/122 |
| 7,275,657 | B2 | 10/2007 | Geyer | |
| 7,445,255 | B2 * | 11/2008 | Nye-Hingston et al. | 292/144 |
| 2007/0063626 | A1 | 3/2007 | Scott | |
| 2010/0176703 | A1 * | 7/2010 | Kim | 312/408 |

* cited by examiner

*Primary Examiner* — Jennifer E. Novosad
(74) *Attorney, Agent, or Firm* — David A. Belasco; Belasco Jacobs & Townsley, LLP

(57) ABSTRACT

A rolling extension tray bag dispenser rack includes a bag pack support tray that has a base, a first side wall, a second side wall, a back wall, a front wall and is sized and shaped to hold a merchandise bag pack. The front wall has an opening sized and shaped to permit extraction of bags from the pack. Rolling extenders are provided that have fixed portions and moving portions. The moving portions are attached to outer surfaces of the first and second side walls or the underside of the support tray and are slidably mounted to the fixed portions. The fixed portions have mounting features for attaching to an underside or back wall of a counter. A spring-loaded check ball or other latching mechanism is mounted to the support tray. A detent panel or other mating latching mechanism is mounted to the underside or back wall of the counter.

14 Claims, 11 Drawing Sheets

FIG. 14
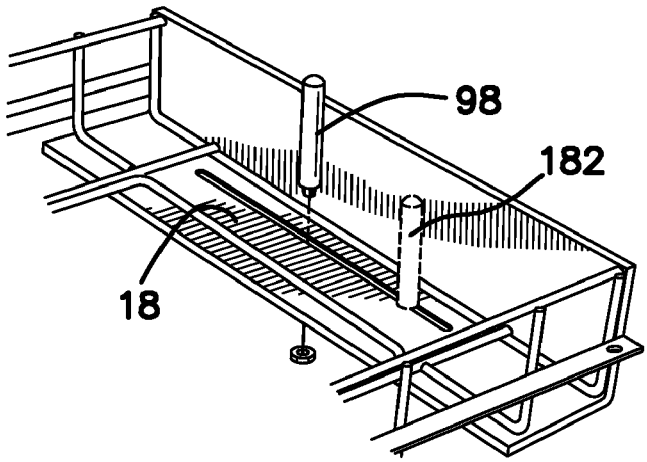
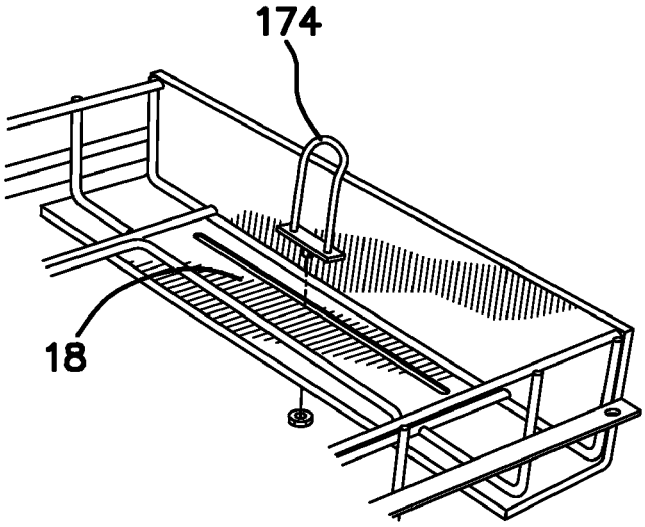
FIG. 15
FIG. 16
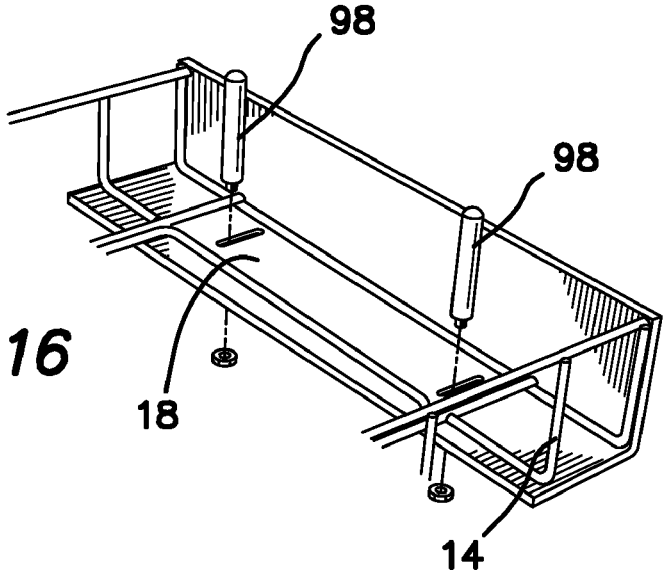

ROLLING EXTENSION TRAY BAG DISPENSER RACK

FIELD OF INVENTION

This invention relates to the field of packaging dispensing systems, and more specifically to space efficient dispensing systems for merchandise bags.

BACKGROUND OF THE INVENTION

Counter space in grocery stores, supermarkets and other retail establishments is often at a premium. Most of these businesses provide disposable merchandise bags for their customers to use in transporting their purchases. When using film bags, such as those made of thermoplastics or similar materials, it is desirable that the bag dispensing systems provide bags that are self-opening. Typically, self-opening bag dispensing systems require a rack that holds a pack of merchandise bags on a central hook and a pair of horizontal arms. Such dispensing systems are usually placed on top of a check-out counter and require a square foot of counter space or more, depending upon the bag size. If self-opening bags can be conveniently dispensed without using this counter space, merchandise can be more efficiently handled at check-out counters.

U.S. Pat. No. 6,543,638, issued to Wile, is directed to a T-shirt type bag dispenser in the form of a tray that slides horizontally in the standard industrial rack. The rack can be mounted beneath a counter and a new frame could be mounted under the counter for a second tray similar to the first tray that is held within the same frame so that it can hold two different sized bags. The horizontal tray slides forward and tilts downward to receive pads of plastic bags. Only the T-shirt handles and upper half of the bags are contained within the frame or rack with the lower half draping over and downward from the front of the rack. The tray slides into the rack and locks into position by means of the ends of three rods that have spacers welded in place so that a cross rod is raised a small distance so that the ends of the three rods, drop below the cross rod so that the ends of the rods drop below the outer edge of the rack locking the tray into the frame so that pulling the bags will not pull the frame out of the rack. To remove the sliding tray the forward end is raised and then it can slide out and down for loading.

U.S. Pat. No. 5,871,115, issued to Kohn is directed to an article support and dispensing rack for use with articles likes plastic bags. The racks include inserts that allow stacking to accommodate different sizes of bags. The removable and adjustable hooks are provided to accommodate the different sizes of bags. The rack has hook members for holding packs of plastic bags. The rack can be placed on a counter or shelf. One embodiment shown includes a housing with a plurality of rack holding members allowing the racks to be slid into place. The rack can have hooks removably mounted on the rods of the racks and bags can be placed on the hooks before being slid onto the rack holding members.

U.S. Pat. No. 5,584,402, issued to Johnson illustrates a bag storage and dispensing rack that slides on a base member between a stowed position for dispensing and an extended position for adding packs of bags. A base member and a sliding bag support member are both of welded wire construction and adapted for mounting on a horizontal surface. A the first embodiment is adapted to mount on a vertical surface. A mounting technique is illustrated for the base member being suspended from horizontal surface utilizing brackets.

U.S. Pat. No. 6,039,422, issued to Butters et al. discloses a sliding and tilting shelf drawer for storing and organizing various articles. The sliding and tilting shelf drawer has a base member having a left track and a right track. The tracks are formed of C-shaped channels. Track rollers are attached to the forward end of the tracks inside the channels. A left slide member and a right slide member are slidingly disposed in the tracks. The slide members are configured as elongated inverted L-shaped members each having a slide roller attached to the back ends. The slide rollers are disposed inside the tracks. The slide members are disposed such they ride on track rollers while the slide rollers ride inside the tracks. The present embodiment provides for the compartment to slide between the storage position and the accessible position. The presently described tracks may be positioned in various locations such as beneath on the lower sides or on the upper sides of the compartments.

U.S. Pat. No. 5,524,763, issued to Wile is directed to a dispensing system for T-shirt type bags. It has a wire rack adapted to be mounted under a merchandiser's checkout counter. The T-shirt type bags are assembled in a disposable tubular cartridge which is supported horizontally by means of a wire rack. The disposable cartridge is formed from a cardboard blank that when installed in the wire rack is retained by a wire hook on the wire rack that retains the bottom panel of cartridge.

U.S. Pat. No. 5,405,021, issued to Smithson discloses a dispenser for dispensing individual pre-formed stacked bags or sheets. The dispenser includes a casing and an anchor plate releasably engaged within the casing. A catch means secured to the underside of the anchor plate engages with a hole in the stack of bags or sheets. The bags or sheets are folded once around the edge of the anchor plate so that the free ends of the bags or sheets project from the mouth of the casing. Individual bags or sheets can be detached at the free end of the stack by pulling the bag or sheet away from the dispenser. Detachment of more than a few bags at a time is made difficult by frictional effects in the stack. An alternative arrangement in which the anchor plate is fixedly mounted to a base is also described.

It is an objective of the present invention to provide a dispensing system for self-opening merchandise bags that minimizes the use of check-out counter space. It is a further objective to provide such a system that can be mounted beneath a check-out counter. It is a still further objective of the invention to provide a bag dispensing system that is easy to load and provides visual inventory of the bags remaining in the bag pack. It is yet a further objective to provide a dispenser that can handle t-shirt style bags as well as header bags. Finally, it is an objective of the present invention to provide a dispensing system that is durable, inexpensive and simple for check-out personnel to operate.

While some of the objectives of the present invention are disclosed in the prior art, none of the inventions found include all of the requirements identified.

SUMMARY OF THE INVENTION

The present invention addresses all of the deficiencies of prior art rolling extension tray bag dispenser rack inventions and satisfies all of the objectives described above.

(1) A rolling extension tray bag dispenser rack includes a bag pack support tray. The support tray has a base, a first side wall, a second side wall, a back wall, a front wall and is sized and shaped to hold a merchandise bag pack. The front wall has an opening. The opening is sized and shaped to permit extraction of bags from the bag pack. A first rolling extender is provided. The first rolling extender has a first fixed portion and a first moving portion. The first moving portion is attached to an outer surface of the first side wall and is slidably mounted to the first fixed portion. A second rolling extender is provided. The second rolling extender has a second fixed portion and a second moving portion. The second moving portion is attached to an outer surface of the second side wall and is slidably mounted to the second fixed portion. The first and second fixed portions have mounting features for attaching the fixed portions to an underside of a counter.

(2) In a variant of the invention, each of the first and second rolling extenders further include at least one guide roller, the guide roller is located between the fixed portion and the moving portion.

(3) In another variant, at least one mounting spike is provided. The at least one mounting spike extends upwardly from the base for a first predetermined distance and is located to align with an aperture extending through the bag pack.

(4) In yet another variant, a spring-loaded check ball is provided. The check ball is located to move vertically and is mounted to an outer surface of the back wall. A detent panel is provided. The detent panel is mounted to the underside of the counter and is shaped and located to engage the spring-loaded check ball. Rearward movement of the support tray will cause the spring-loaded check ball to removably engage the detent panel, thereby retaining the tray in a rearmost position.

(5) In still another variant, a magnetic latch is provided. The magnetic latch has a first portion and a second portion. The second portion is magnetically attracted to the first portion. The first portion is attached to an outer surface of the back wall. The second portion is attached to the underside of the counter and is shaped and located to engage the first portion. Rearward movement of the support tray will cause the first portion to removably engage the second portion, thereby retaining the tray in a rearmost position.

(6) In a further variant, the bag pack support tray is formed from materials selected from the group that includes wire, injection molded material, sheet metal and wood.

(7) In still a further variant, the bag pack support tray is sized and shaped to hold a plurality of merchandise bags in a stacked configuration.

(8) In yet a further variant, the bag pack support tray is sized and shaped to hold a plurality of merchandise bags in a folded configuration.

(9) In another variant, a first fastening device is provided. The first fastening device is attached to one of the underside of the counter or the bag pack support tray. A mating second fastening device is provided. The mating second fastening device is attached to the other of the underside of the counter or the bag pack support tray. The first fastening device is removably attachable to the mating second fastening device when the support tray is in a rearmost position.

(10) In still another variant of the invention, the first fastening device is selected from the group that includes hooks, loops, bails and chains. The mating second fastening device is selected from the group that includes components sized shaped and located to removably engage the first fastening device.

(11) In yet another variant, a rolling extension tray bag dispenser rack, includes a bag pack support tray. The support tray has a base, a first side wall, a second side wall, a back wall, a front wall and is sized and shaped to hold a merchandise bag pack. The front wall has an opening sized and shaped to permit extraction of bags from the bag pack. A central rolling extender is provided. The central rolling extender has a fixed portion and a moving portion. The moving portion is attached to an outer, lower surface of the base and is slidably mounted to the fixed portion. The fixed portion has mounting features for attaching the fixed portion to either an underside of a counter or an inside surface of a back wall of a counter.

(12) In a further variant, the central rolling extender further includes at least one guide roller. The guide roller is located between the fixed portion and the moving portion.

(13) In still a further variant, the rolling extension tray bag dispenser rack further includes at least one mounting spike. The at least one mounting spike extends upwardly from the base for a first predetermined distance and is located to align with an aperture extending through the bag pack.

(14) In yet a further variant, a spring-loaded check ball is provided. The check ball is located to move vertically and is mounted to an outer surface of the back wall. A detent panel is provided. The detent panel is mounted to the underside of the counter and is shaped and located to engage the spring-loaded check ball. Rearward movement of the support tray will cause the spring-loaded check ball to removably engage the detent panel, thereby retaining the tray in a rearmost position.

(15) In another variant of the invention, a magnetic latch is provided. The magnetic latch has a first portion and a second portion. The second portion is magnetically attracted to the first portion. The first portion is attached to an outer surface of the back wall. The second portion is attached to the underside of the counter and is shaped and located to engage the first portion. Rearward movement of the support tray will cause the first portion to removably engage the second portion, thereby retaining the tray in a rearmost position.

(16) In still another variant, the bag pack support tray is formed from materials selected from the group includes wire, injection molded material, sheet metal and wood.

(17) In yet another variant, the bag pack support tray is sized and shaped to hold a plurality of merchandise bags in a stacked configuration.

(18) In a further variant, the bag pack support tray is sized and shaped to hold a plurality of merchandise bags in a folded configuration.

(19) In still a further variant, a first fastening device is provided. The first fastening device is attached to one of the underside of the counter or the bag pack support tray. A mating second fastening device is provided. The mating second fastening device is attached to the other of the underside of the counter or the bag pack support tray. The first fastening device is removably attachable to the mating second fastening device when the support tray is in a rearmost position.

(20) In yet a further variant of the invention, the first fastening device is selected from the group includes hooks, loops, bails, chains and hooking and looping (Velcro®) fasteners and the mating second fastening device is selected from the group includes components sized shaped and located to removably engage the first fastening device.

(21) In another variant of the invention, the at least one mounting spike is removably attached to the base.

(22) In still another variant, the at least one mounting spike is movably attached to the base, thereby providing alternative locations for the mounting spike on the base.

(23) In yet another variant, at least one securing hook is provided. The at least one securing hook is attached to the base and is located to align with an aperture extending through the bag pack.

(24) In a further variant, the at least one securing hook is removably attached to the base.

(25) In a final variant, the at least one securing hook is movably attached to the base, thereby providing alternative locations for the securing hook on the base.

An appreciation of the other aims and objectives of the present invention and an understanding of it may be achieved by referring to the accompanying drawings and the detailed description of a preferred embodiment.

DESCRIPTION OF THE DRAWINGS

FIG. 14 is a partial perspective view of the bag pack support tray of the FIG. 1 embodiment illustrating a pair of laterally movable/removable mounting spikes;

FIG. 15 is a partial perspective view of the bag pack support tray of the FIG. 1 embodiment illustrating a laterally movable/removable securing hook; and FIG. 16 is a partial perspective view of the bag pack support tray of the FIG. 1 embodiment illustrating a fore and aft movable/removable pair of mounting spikes.

DETAILED DESCRIPTION OF THE PREFERRED EMBODIMENT (1) FIGS. 1-16 illustrate a rolling extension tray bag dispenser rack 10 that includes a bag pack support tray 14. As illustrated in FIGS. 1, 5 and 5A, the support tray 14 has a base 18, a first side wall 22, a second side wall 26, a back wall 30, a front wall 34 and is sized and shaped to hold a merchandise bag pack 38. The front wall 34 has an opening 42. The opening 42 is sized and shaped to permit extraction of bags 46 from the bag pack 38. A first rolling extender 50 is provided. The first rolling extender 50 has a first fixed portion 54 and a first moving portion 58. The first moving portion 58 is attached to an outer surface 62 of the first side wall 22 and is slidably mounted to the first fixed portion 54. A second rolling extender 66 is provided. The second rolling extender 66 has a second fixed portion 70 and a second moving portion 74. The second moving portion 74 is attached to an outer surface 78 of the second side wall 26 and is slidably mounted to the second fixed portion 70. The first 54 and second 70 fixed portions have mounting features 82 for attaching the fixed portions 54, 70 to an underside 86 of a counter 90.

Figure 1:
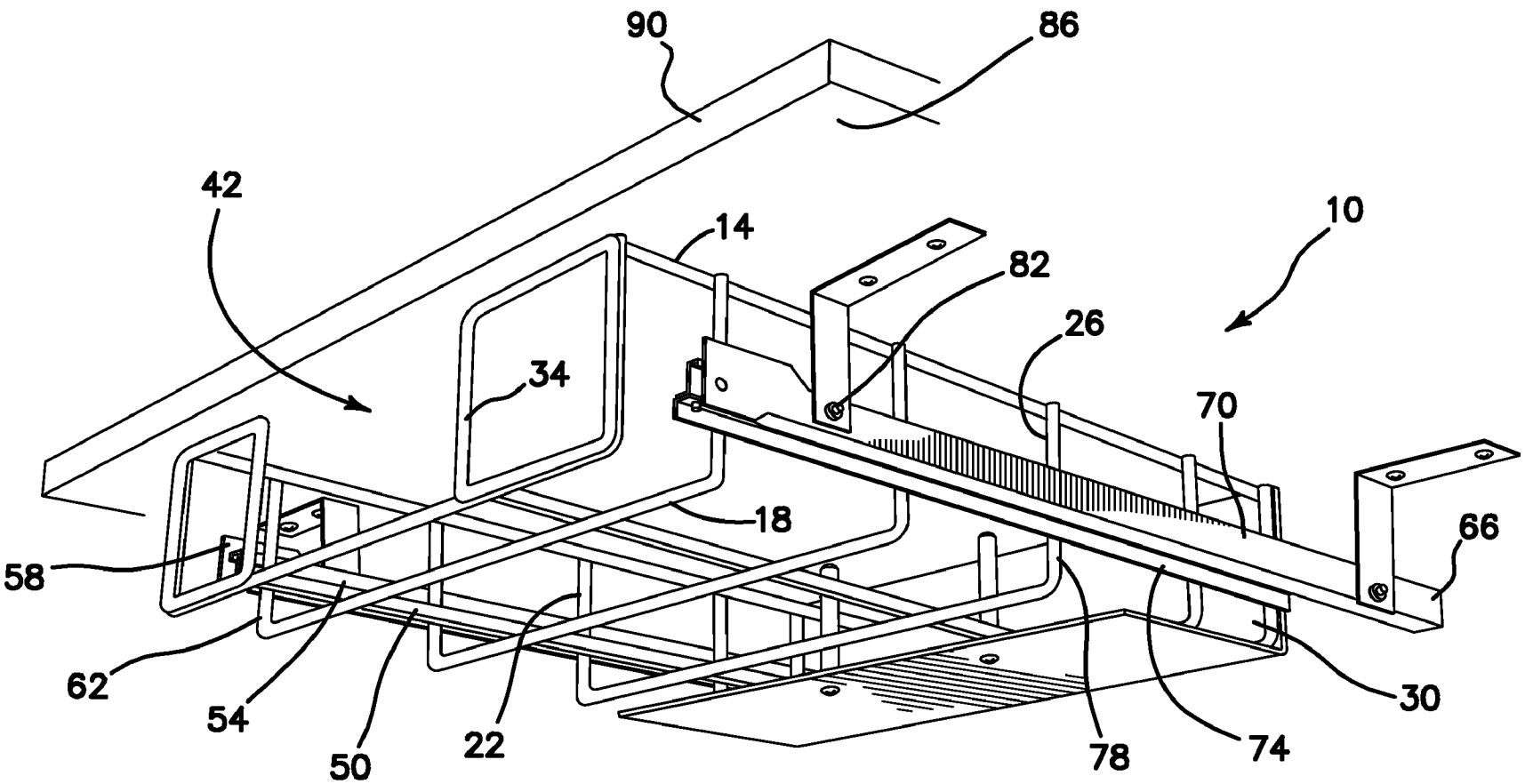
FIG. 1 is a perspective view of the preferred embodiment of the invention illustrating the bag pack support tray and rolling extenders attached to the underside of a counter.
Figure 2:
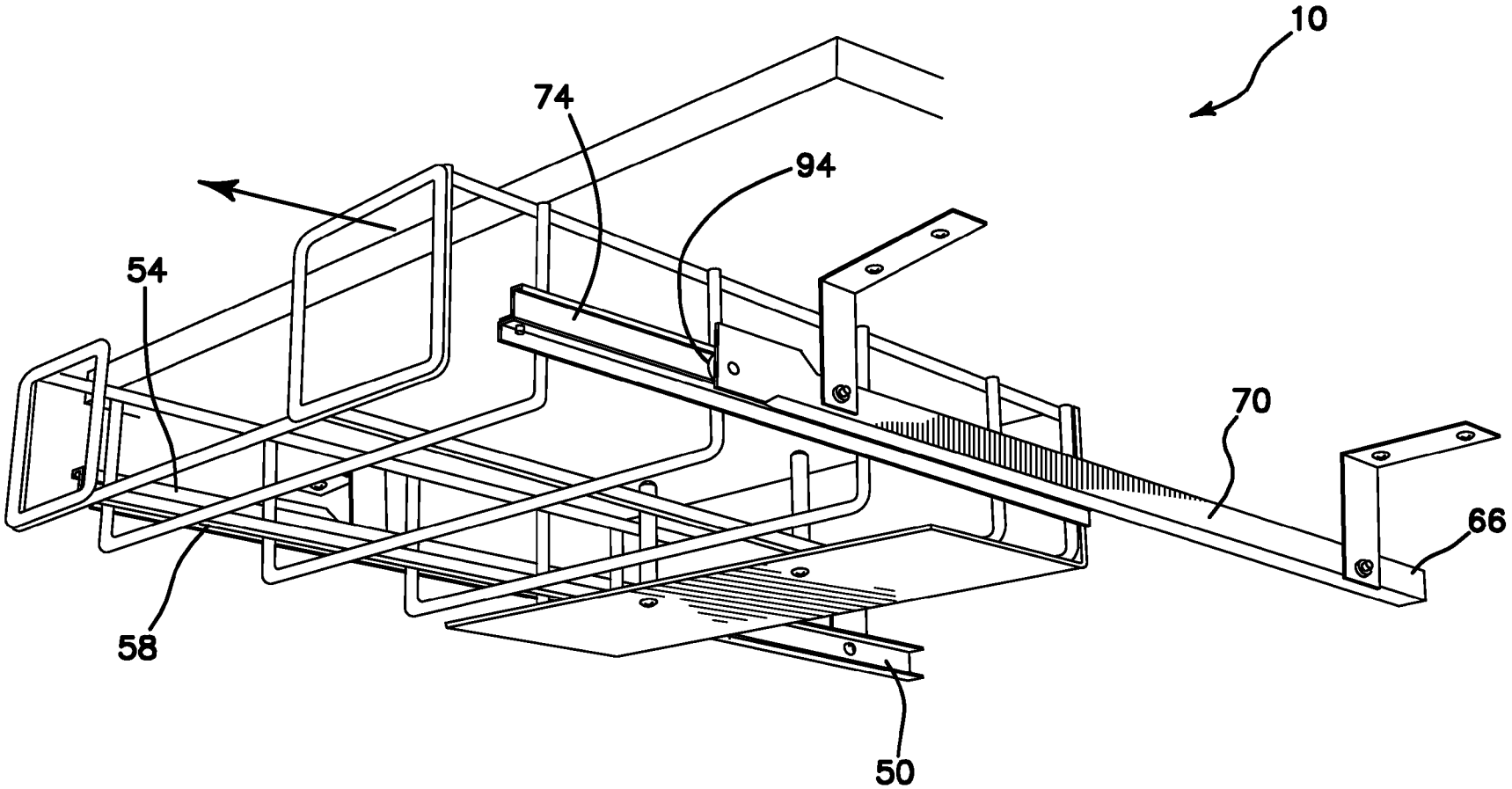
FIG. 2 is a perspective view of the FIG. 1 embodiment being moved to an open, loading position.

(2) In a variant of the invention, as illustrated in FIG. 2, each of the first 50 and second 66 rolling extenders further include at least one guide roller 94, the guide roller 94 is located between the fixed portion 54, 70 and the moving portion 58, 74.

Figure 5:
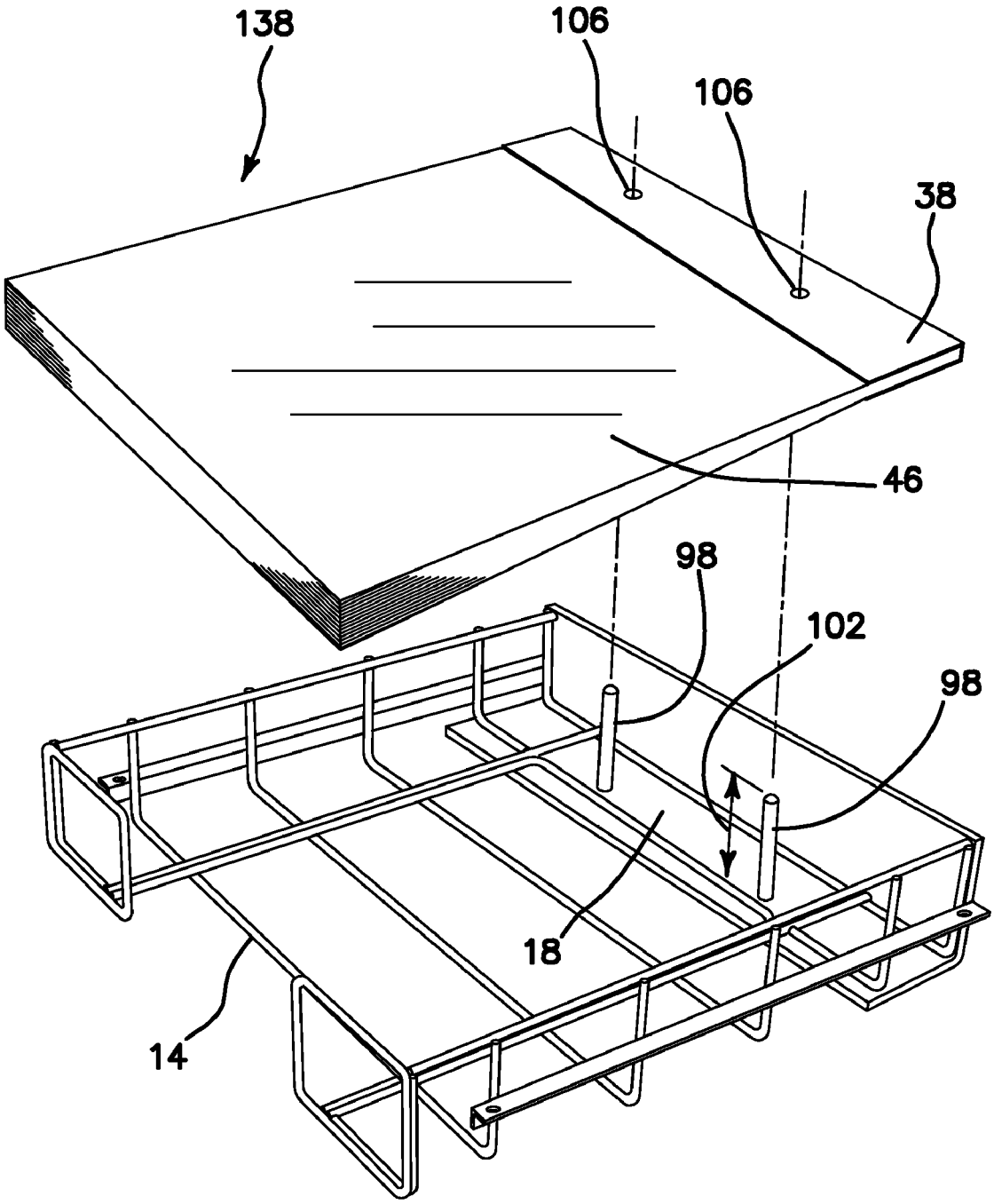
FIG. 5 is a perspective view of the bag pack support tray of the FIG. 1 embodiment illustrating two bag support spikes and a pack of header bags.
Figure 5A:
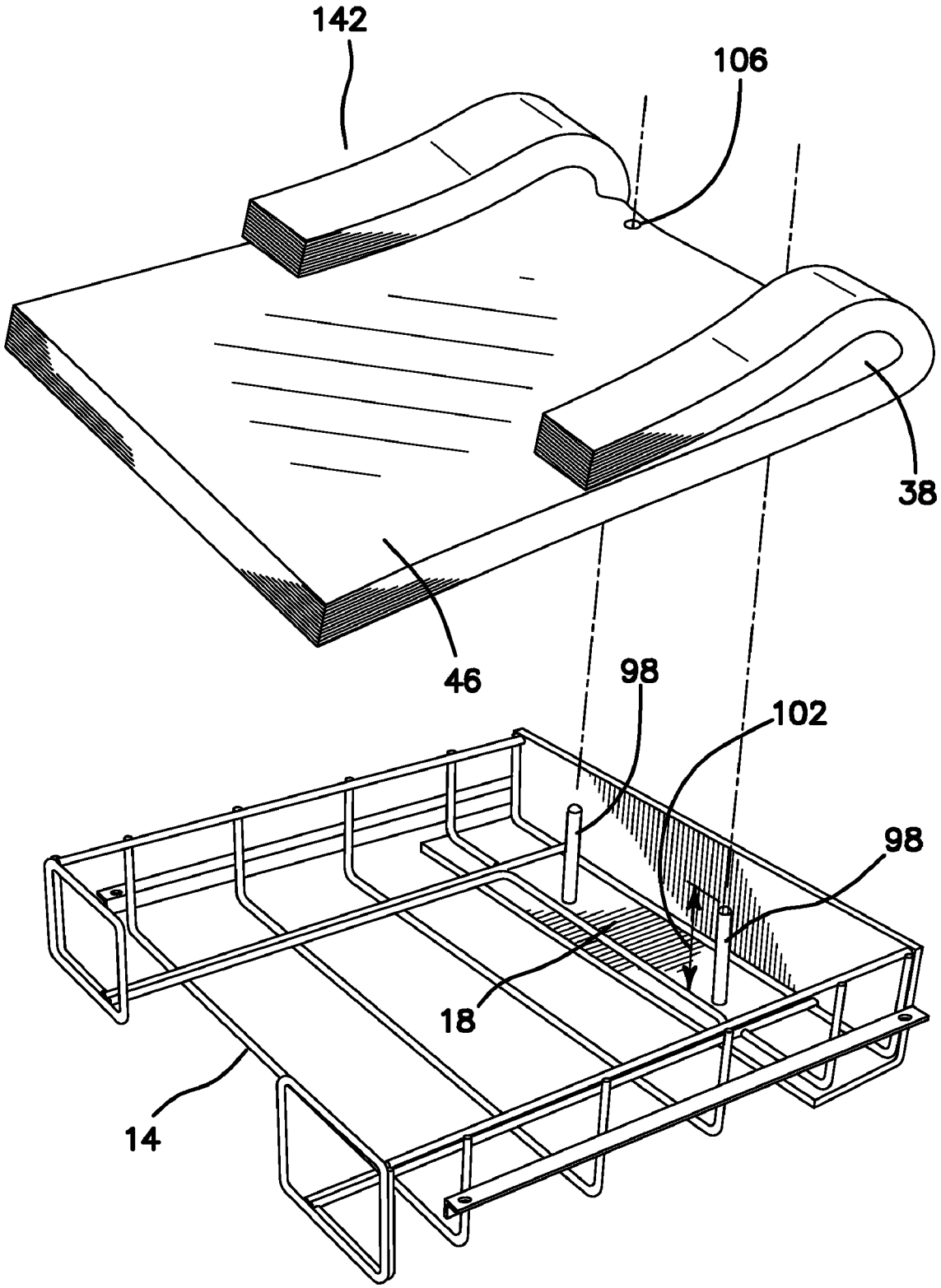
FIG. 5A is a perspective view of the bag pack support tray of the FIG. 1 embodiment illustrating two bag support spikes and a pack of T-shirt style bags.
Figure 6:
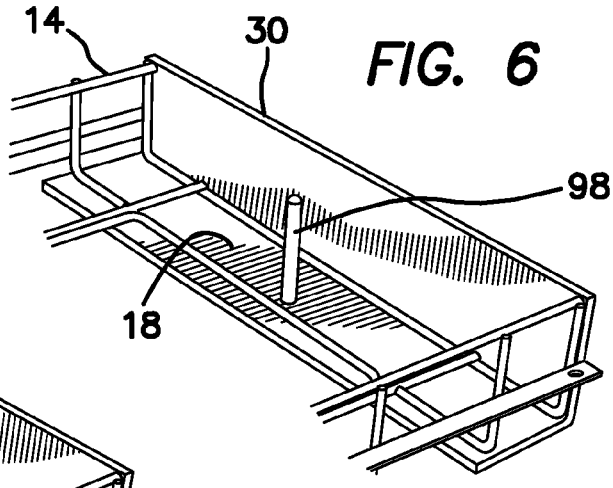
FIG. 6 is a perspective view of the bag pack support tray of the FIG. 1 embodiment illustrating one bag support spike.
Figure 7:
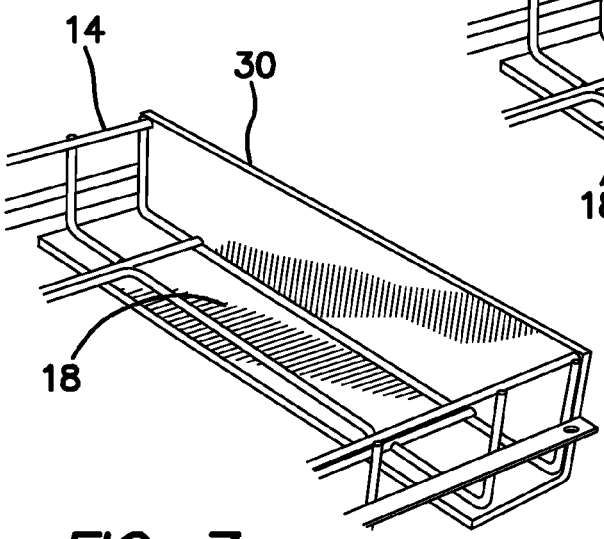
FIG. 7 is a perspective view of the bag pack support tray of the FIG. 1 embodiment without bag support spikes.
Figure 10:
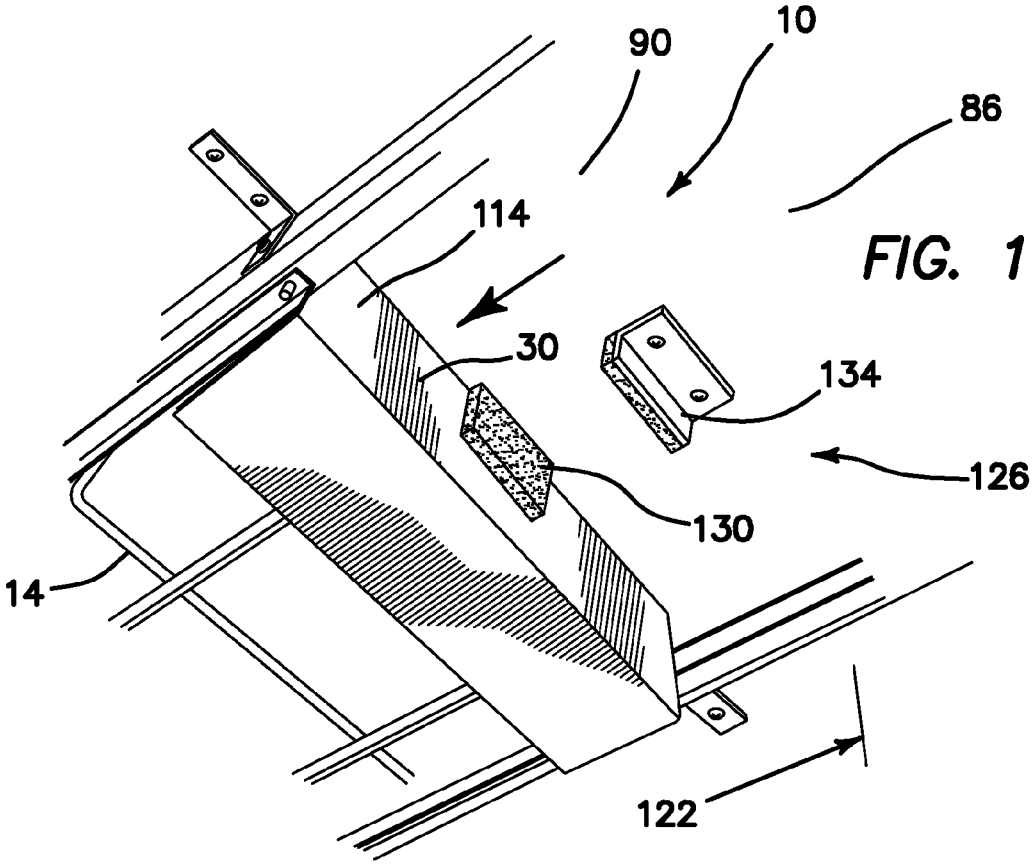
FIG. 10 is a partial perspective view of the FIG. 1 embodiment illustrating a magnetic tray retaining mechanism.

(3) In another variant, as illustrated in FIGS. 5, 5A and 6, at least one mounting spike 98 is provided. The at least one mounting spike 98 extends upwardly from the base 18 for a first predetermined distance 102 and is located to align with an aperture 106 extending through the bag pack 38.

Figure 3:
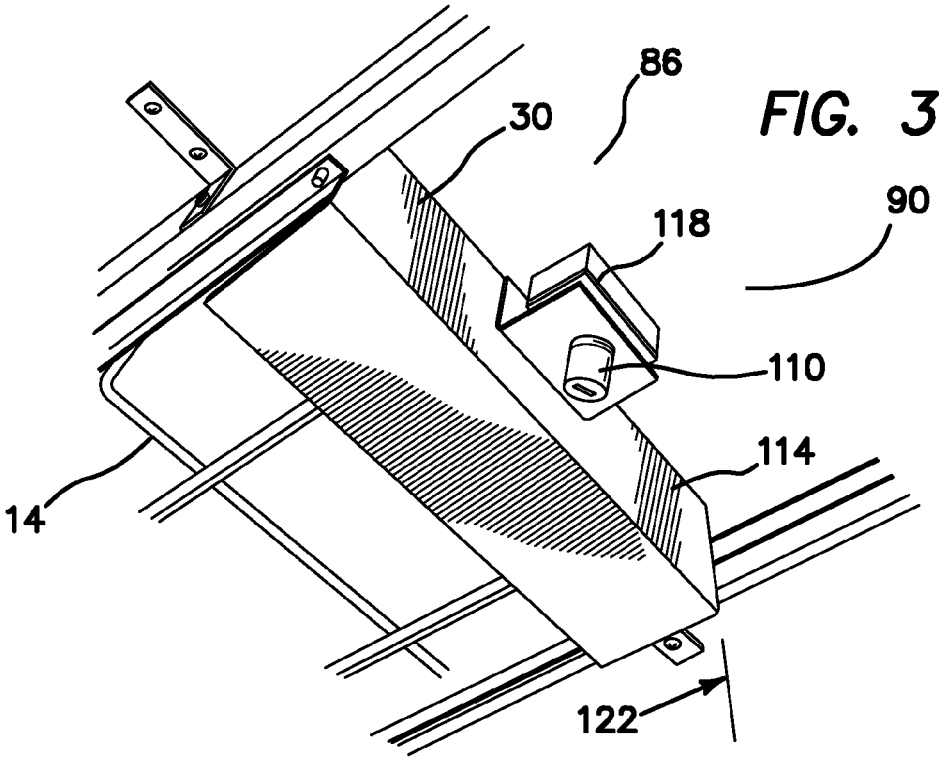
FIG. 3 is a perspective view of the spring-loaded check ball and detent of the FIG. 1 embodiment in the latched position.
Figure 4:
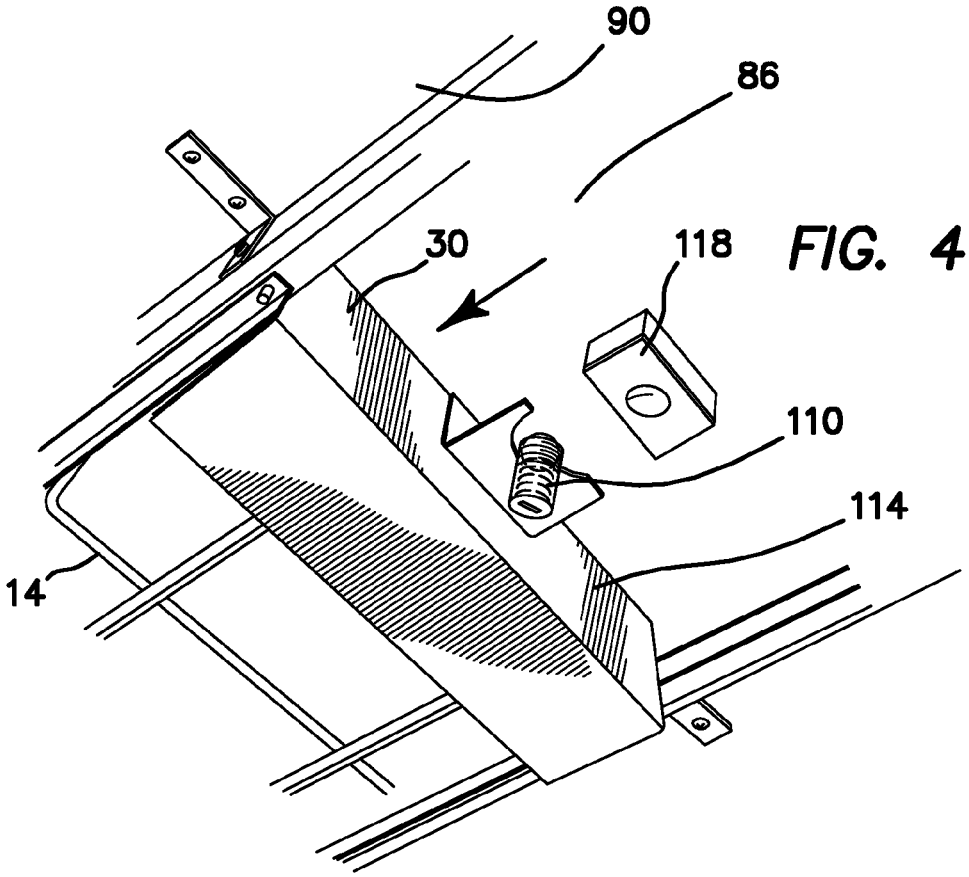
FIG. 4 is a perspective view of the spring-loaded check ball and detent of the FIG. 1 embodiment in the unlatched position.

(4) In yet another variant, as illustrated in FIGS. 3 and 4, a spring-loaded check ball 110 is provided. The check ball 110 is located to move vertically and is mounted to an outer surface 114 of the back wall 30. A detent panel 118 is provided. The detent panel 118 is mounted to the underside 86 of the counter 90 and is shaped and located to engage the spring-loaded check ball 110. Rearward movement of the support tray 14 will cause the spring-loaded check ball 110 to removably engage the detent panel 118, thereby retaining the tray 14 in a rearmost position 122.

Figure 8:
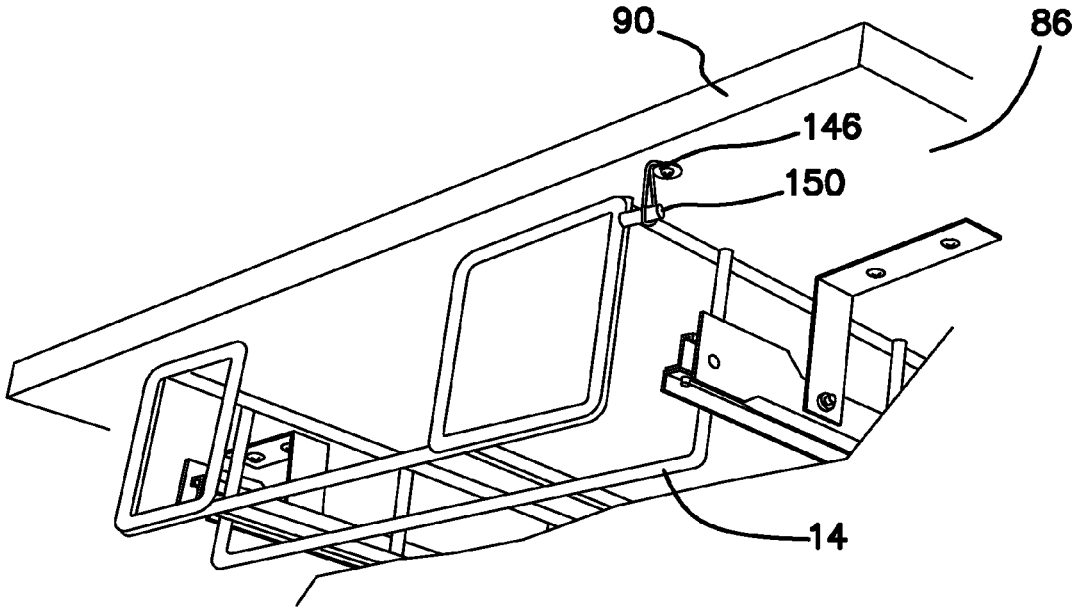
FIG. 8 is a partial perspective view of the FIG. 1 embodiment illustrating a loop and post tray retaining mechanism with the tray in a closed position.
Figure 9:
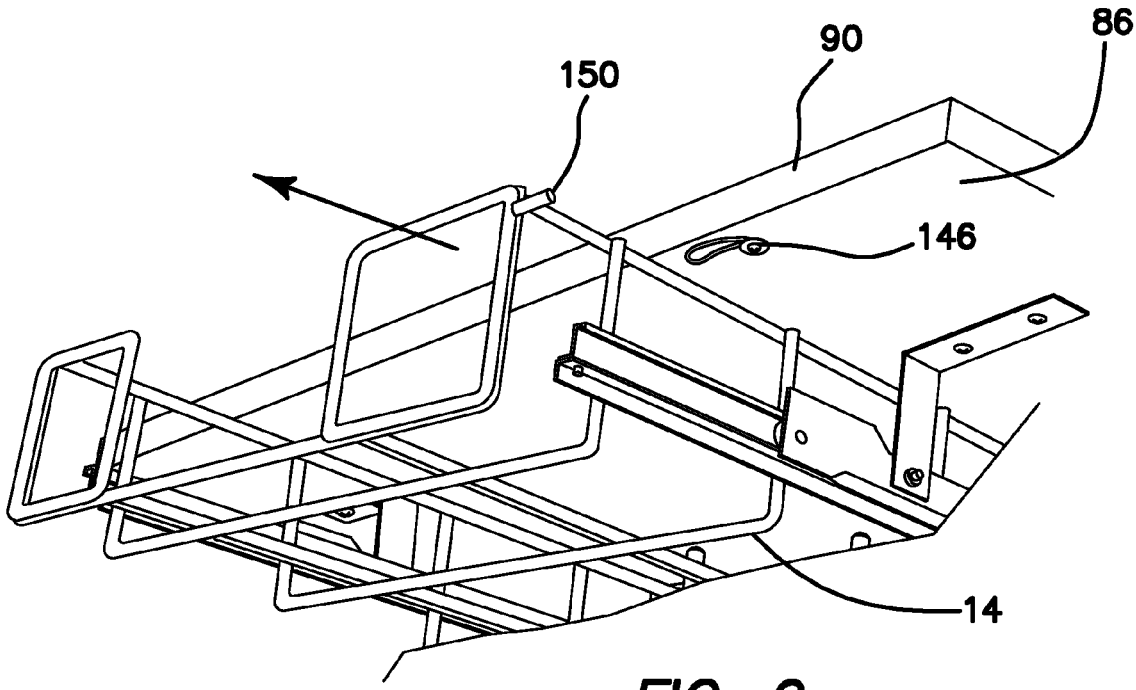
FIG. 9 is a partial perspective view of the FIG. 1 embodiment illustrating a loop and post tray retaining mechanism with the tray in an open position.

(5) In still another variant, as illustrated in FIGS. 8 and 9, a magnetic latch 126 is provided. The magnetic latch 126 has a first portion 130 and a second portion 134. The second portion 134 is magnetically attracted to the first portion 130. The first portion 130 is attached to an outer surface 114 of the back wall 30. The second portion 134 is attached to the underside 86 of the counter 90 and is shaped and located to engage the first portion 130. Rearward movement of the support tray 14 will cause the first portion 130 to removably engage the second portion 134, thereby retaining the tray 14 in a rearmost position 122.

(6) In a further variant, the bag pack support tray 14 is formed from materials selected from the group that includes wire, injection molded material, sheet metal and wood.

(7) In still a further variant, as illustrated in FIG. 5, the bag pack support tray 14 is sized and shaped to hold a plurality of merchandise bags 46 in a stacked configuration 138.

(8) In yet a further variant, as illustrated in FIG. 5A, the bag pack support tray 14 is sized and shaped to hold a plurality of merchandise bags 46 in a folded configuration 142.

(9) In another variant, as illustrated in FIGS. 8 and 9, a first fastening device 146 is provided. The first fastening device 146 is attached to one of the underside 86 of the counter 90 or the bag pack support tray 14. A mating second fastening 150 device is provided. The mating second fastening device 150 is attached to the other of the underside 86 of the counter 90 or the bag pack support tray 14. The first fastening device 146 is removably attachable to the mating second fastening device 150 when the support tray 14 is in a rearmost position 122.

Figure 11:
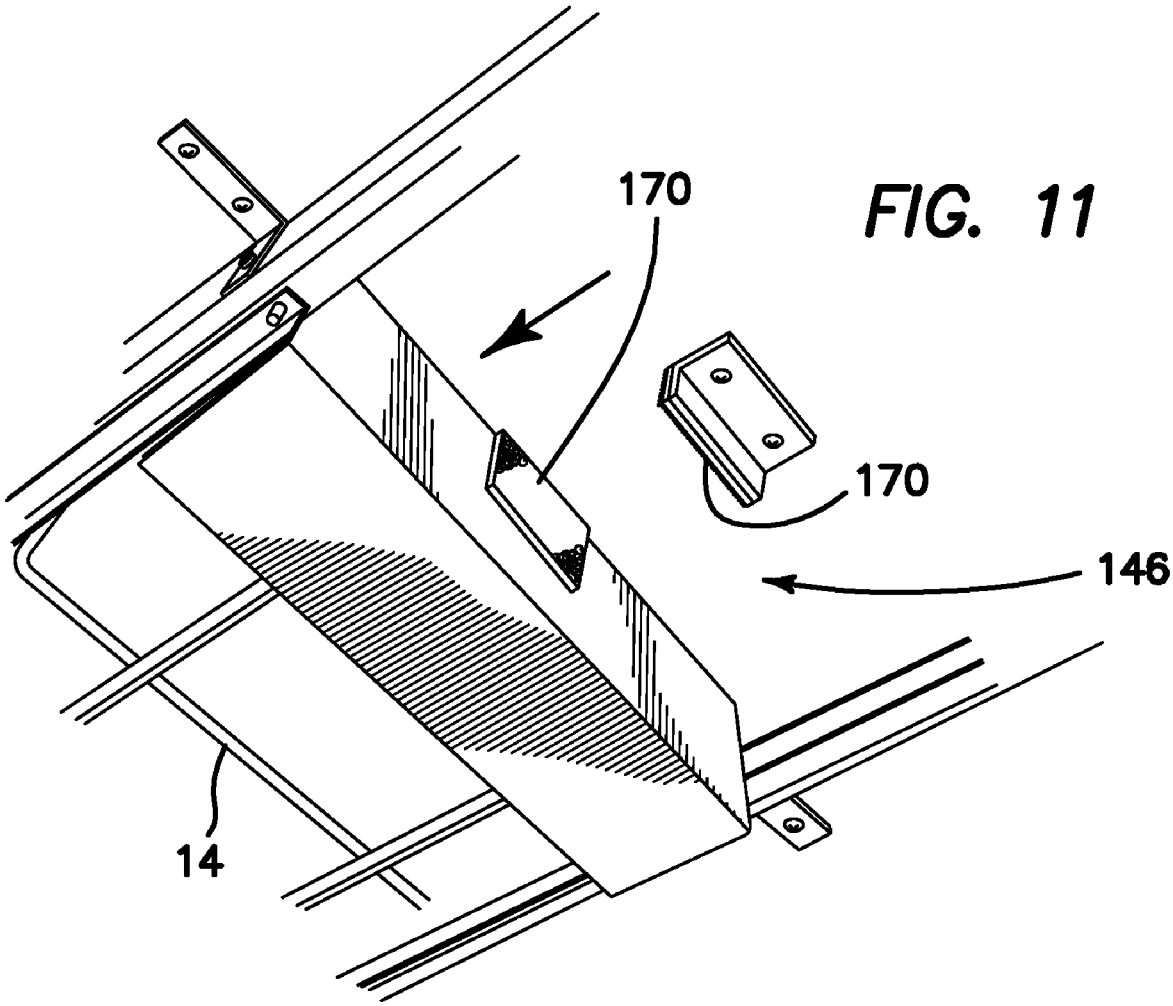
FIG. 11 is a partial perspective view of the FIG. 1 embodiment illustrating a loop and hook (Velcro®) tray retaining mechanism.

(10) In still another variant of the invention, as illustrated in FIGS. 8, 9 and 11, the first fastening device 146 is selected from the group that includes hooks 154, loops 158, bails 162, chains 166 and hooking or looping fasteners 170. The mating second fastening device 150 is selected from the group that includes components sized shaped and located to removably engage the first fastening device 146.

Figure 12:
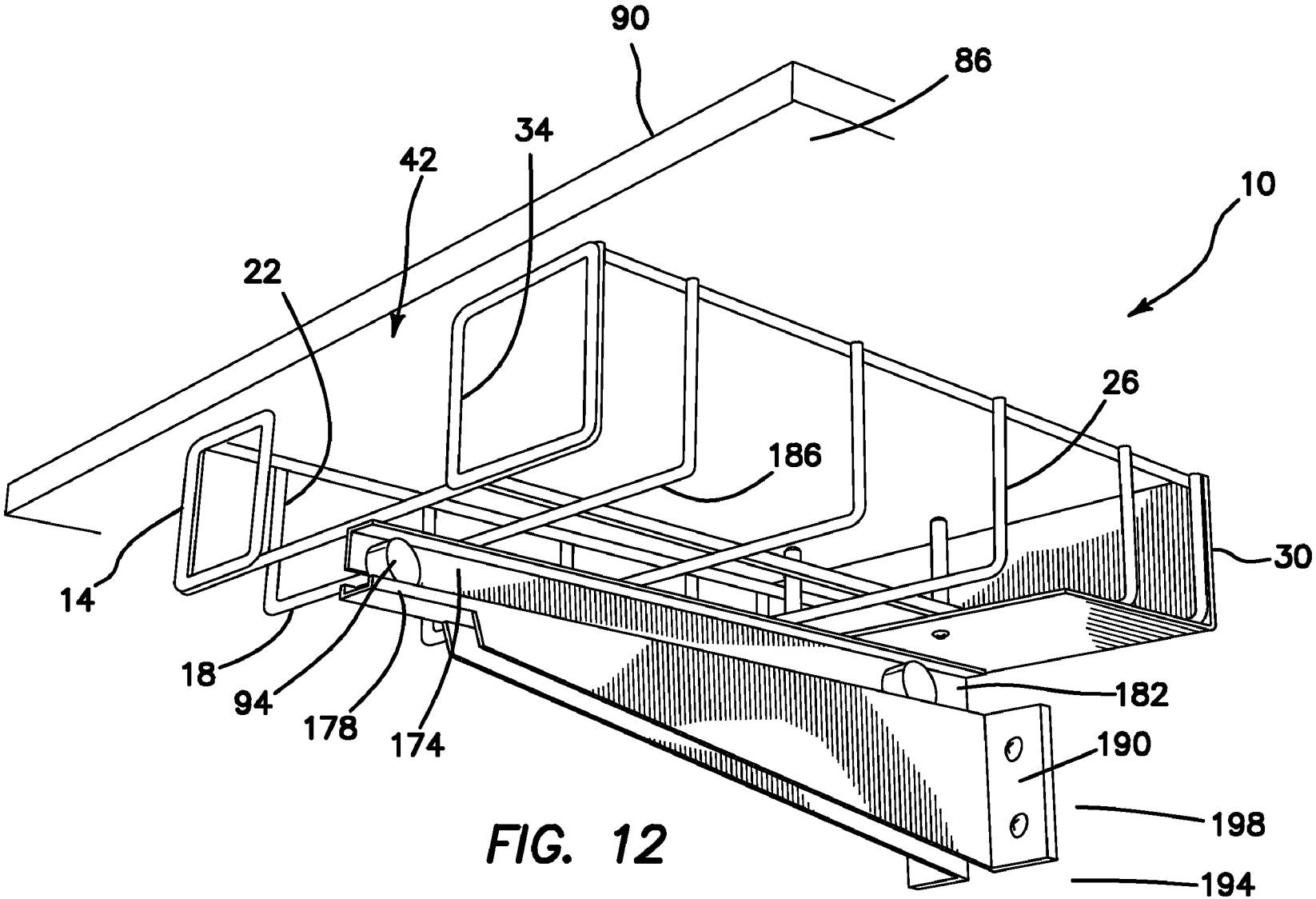
FIG. 12 is a perspective view of an alternative embodiment having a center rolling extender mounted to the underside of the tray and the back wall of a counter.
Figure 13:
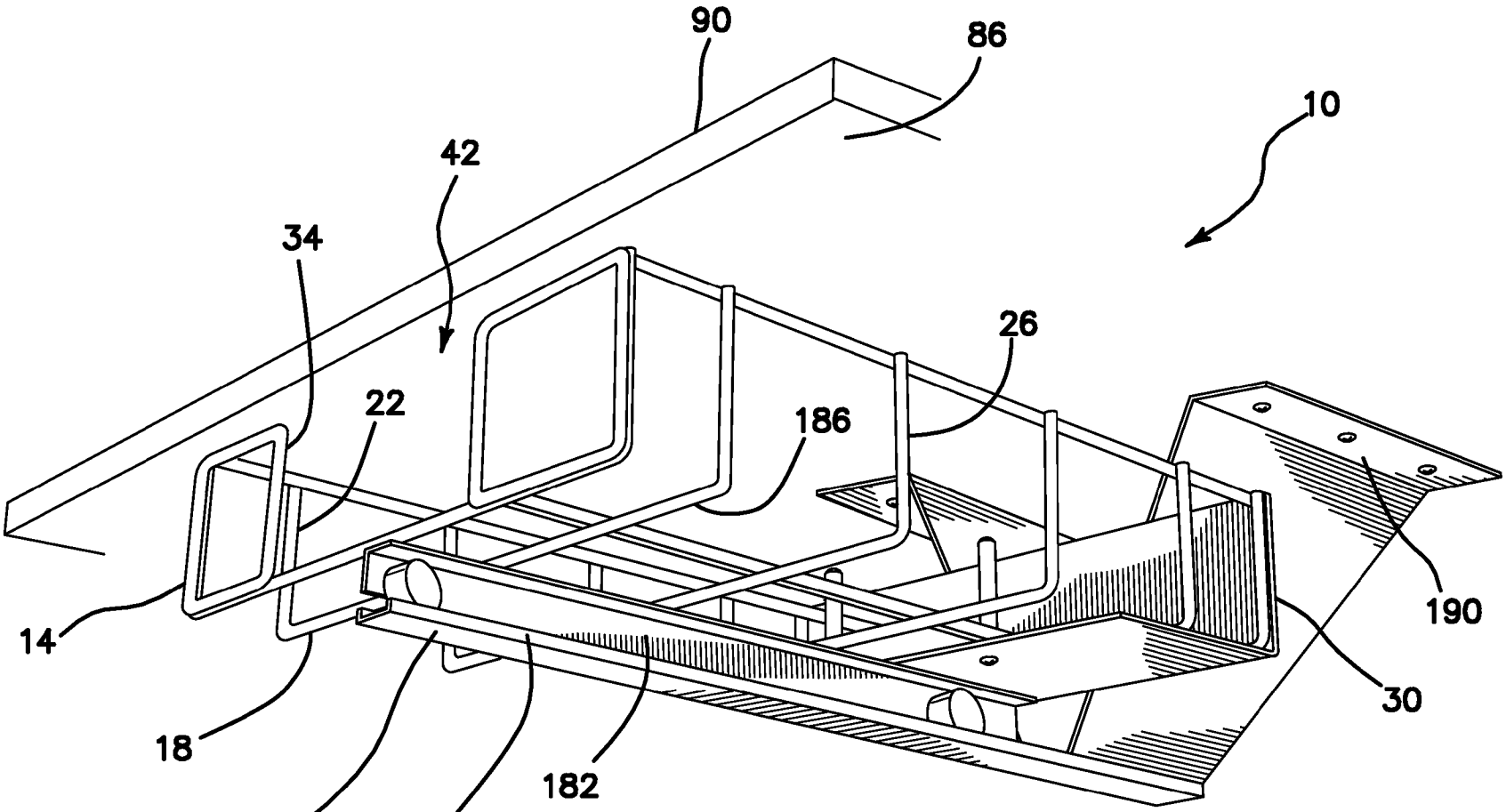
FIG. 13 is a perspective view of an alternative embodiment having a center rolling extender mounted to the underside of a counter.

(11) In yet another variant, as illustrated in FIGS. 12 and 13, a rolling extension tray bag dispenser rack 10, includes a bag pack support tray 14. The support tray 14 has a base 18, a first side wall 22, a second side wall 26, a back wall 30, a front wall 34 and is sized and shaped to hold a merchandise bag pack 38. The front wall 34 has an opening 42 sized and shaped to permit extraction of bags 46 from the bag pack 38. A central rolling extender 174 is provided. The central rolling extender 174 has a fixed portion 178 and a moving portion 182. The moving portion 182 is attached to an outer, lower surface 186 of the base 18 and is slidably mounted to the fixed portion 178. The fixed portion 178 has mounting features 190 for attaching the fixed portion 178 to either an underside 86 of a counter 90 or an inside surface 194 of a back wall 198 of a counter 90.

(12) In a further variant, the central rolling extender 174 further includes at least one guide roller 94. The guide roller 94 is located between the fixed portion 178 and the moving portion 182.

(13) In still a further variant, as illustrated in FIGS. 5, 5A and 6, the rolling extension tray bag dispenser rack 10 further includes at least one mounting spike 98. The at least one mounting spike 98 extends upwardly from the base 18 for a first predetermined distance 102 and is located to align with an aperture 106 extending through the bag pack 38.

(14) In yet a further variant, as illustrated in FIGS. 3 and 4, a spring-loaded check ball 110 is provided. The check ball 110 is located to move vertically and is mounted to an outer surface 114 of the back wall 30. A detent panel 118 is provided. The detent panel 118 is mounted to the underside 86 of the counter 90 and is shaped and located to engage the spring-loaded check ball 110. Rearward movement of the support tray 14 will cause the spring-loaded check ball 110 to removably engage the detent panel 118, thereby retaining the tray 14 in a rearmost position 122.

(15) In another variant of the invention, as illustrated in FIGS. 8 and 9, a magnetic latch 126 is provided. The magnetic latch 126 has a first portion 130 and a second portion 134. The second portion 134 is magnetically attracted to the first portion 130. The first portion 130 is attached to an outer surface 114 of the back wall 30. The second portion 134 is attached to the underside 86 of the counter 90 and is shaped and located to engage the first portion 130. Rearward movement of the support tray 14 will cause the first portion 130 to removably engage the second portion 134, thereby retaining the tray 14 in a rearmost position 122.

(16) In still another variant, the bag pack support tray 14 is formed from materials selected from the group includes wire, injection molded material, sheet metal and wood.

(17) In yet another variant, as illustrated in FIG. 5, the bag pack support tray 14 is sized and shaped to hold a plurality of merchandise bags 46 in a stacked configuration 138.

(18) In a further variant, as illustrated in FIG. 5A, the bag pack support tray 14 is sized and shaped to hold a plurality of merchandise bags 46 in a folded configuration 142.

(19) In still a further variant, as illustrated in FIGS. 8 and 9, a first fastening device 146 is provided. The first fastening device 146 is attached to one of the underside 86 of the counter 90 or the bag pack support tray 14. A mating second fastening 150 device is provided. The mating second fastening device 150 is attached to the other of the underside 86 of the counter 90 or the bag pack support tray 14. The first fastening device 146 is removably attachable to the mating second fastening device 150 when the support tray 14 is in a rearmost position 122.

(20) In yet a further variant of the invention, as illustrated in FIGS. 8, 9 and 11, the first fastening device 146 is selected from the group that includes hooks 154, loops 158, bails 162, chains 166 and hooking or looping fasteners 170. The mating second fastening device 150 is selected from the group that includes components sized shaped and located to removably engage the first fastening device 146.

(21) In another variant of the invention, as illustrated in FIGS. 14 and 16, the at least one mounting spike 98 is removably attached to the base 18.

(22) In still another variant, the at least one mounting spike 98 is movably attached to the base 18, thereby providing alternative locations for the mounting spike 98 on the base 18.

(23) In yet another variant, as illustrated in FIG. 15, at least one securing hook 174 is provided. The at least one securing hook 174 is attached to the base 18 and is located to align with an aperture 178 extending through the bag pack 38.

(24) In a further variant, the at least one securing hook 174 is removably attached to the base 18.

(25) In a final variant, the at least one securing hook 174 is movably attached to the base 18, thereby providing alternative locations 182 for the securing hook 174 on the base 18.

The rolling extension tray bag dispenser rack 10 has been described with reference to particular embodiments. Other modifications and enhancements can be made without departing from the spirit and scope of the claims that follow.

The invention claimed is:

1. A rolling extension tray bag dispenser rack, comprising:

a bag pack support tray, said support tray having a base, a first side wall, a second side wall, a back wall, a front wall and being sized and shaped to hold a merchandise bag pack;

said front wall having an opening, said opening sized and shaped to permit extraction of bags from said bag pack;

a first rolling extender, said first rolling extender having a first fixed portion and a first moving portion, said first moving portion being attached to an outer surface of said first side wall and being slidably mounted to said first fixed portion;

a second rolling extender, said second rolling extender having a second fixed portion and a second moving portion, said second moving portion being attached to an outer surface of said second side wall and being slidably mounted to said second fixed portion;

said first and second fixed portions having mounting features for attaching said fixed portions to an underside of a counter;

a spring-loaded check ball, said check ball disposed to move vertically and being mounted to an outer surface of said back wall;

a detent panel, said detent panel being mounted to said underside of said counter and being shaped and disposed to engage said spring-loaded check ball; and wherein rearward movement of said support tray will cause said spring-loaded check ball to removably engage said detent panel, thereby retaining said tray in a rearmost position.

2. The rolling extension tray bag dispenser rack, as described in claim 1, wherein each of said first and second rolling extenders further comprise at least one guide roller, said guide roller being disposed between said fixed portion and said moving portion.

3. The rolling extension tray bag dispenser rack, as described in claim 1, further comprising at least one mounting spike, said at least one mounting spike extending upwardly from said base for a first predetermined distance and being disposed to align with an aperture extending through said bag pack.

4. The rolling extension tray bag dispenser rack, as described in claim 3, wherein said at least one mounting spike is removably attached to said base.

5. The rolling extension tray bag dispenser rack, as described in claim 3, wherein said at least one mounting spike is movably attached to said base, thereby providing alternative locations for said mounting spike on said base.

6. The rolling extension tray bag dispenser rack, as described in claim 1, further comprising:

a magnetic latch, said magnetic latch having a first portion and a second portion, said second portion being magnetically attracted to said first portion;

said first portion being attached to an outer surface of said back wall, said second portion being attached to said underside of said counter and being shaped and disposed to engage said first portion; and wherein rearward movement of said support tray will cause said first portion to removably engage said second portion, thereby retaining said tray in a rearmost position.

7. The rolling extension tray bag dispenser rack, as described in claim 1, wherein said bag pack support tray is formed from materials selected from the group comprising:

wire, injection molded material, sheet metal and wood.

8. The rolling extension tray bag dispenser rack, as described in claim 1, wherein said bag pack support tray is sized and shaped to hold a plurality of merchandise bags in a stacked configuration.

9. The rolling extension tray bag dispenser rack, as described in claim 1, wherein said bag pack support tray is sized and shaped to hold a plurality of merchandise bags in a folded configuration.

10. The rolling extension tray bag dispenser rack, as described in claim 1, further comprising:

a first fastening device, said first fastening device being attached to one of said underside of said counter and said bag pack support tray;

a mating second fastening device, said mating second fastening device being attached to the other of said underside of said counter and said bag pack support tray;

said first fastening device being removably attachable to said mating second fastening device when said support tray is in a rearmost position.

11. The rolling extension tray bag dispenser rack, as described in claim 10, wherein:

said first fastening device is selected from the group comprising hooks, loops, bails and chains; and said mating second fastening device is selected from the group comprising components sized shaped and disposed to removably engage said first fastening device.

12. The rolling extension tray bag dispenser rack, as described in claim 1, further comprising at least one securing hook, said at least one securing hook being attached to said base and being disposed to align with an aperture extending through said bag pack.

13. The rolling extension tray bag dispenser rack, as described in claim 12, wherein said at least one securing hook is removably attached to said base.

14. The rolling extension tray bag dispenser rack, as described in claim 12, wherein said at least one securing hook is movably attached to said base, thereby providing alternative locations for said securing hook on said base.

* * * * *